US007182373B2

(12) United States Patent
Yamada

(10) Patent No.: US 7,182,373 B2
(45) Date of Patent: Feb. 27, 2007

(54) SIDE LOCK APPARATUS FOR STORAGES

(75) Inventor: Satoshi Yamada, Kanagawa (JP)

(73) Assignee: Piolax, Inc., Yokohama (JP)

( * ) Notice: Subject to any disclaimer, the term of this patent is extended or adjusted under 35 U.S.C. 154(b) by 46 days.

(21) Appl. No.: 10/824,634

(22) Filed: Apr. 15, 2004

(65) Prior Publication Data

US 2004/0256859 A1 Dec. 23, 2004

(30) Foreign Application Priority Data

Apr. 17, 2003 (JP) ..... P.2003-112484

(51) Int. Cl.
*E05C 1/00* (2006.01)
*E05C 1/02* (2006.01)

(52) U.S. Cl. ..... 292/32; 292/38; 292/40; 292/141; 292/143; 292/171; 292/173

(58) Field of Classification Search ..... 292/32–34, 292/36–38, 137, 156, 157–159, 163–165, 292/167, 171, DIG. 11, 26, 48, 336.3, 141, 292/143

See application file for complete search history.

(56) References Cited

U.S. PATENT DOCUMENTS 886,254 A * 4/1908 Rumery ..... 292/40
926,173 A * 6/1909 Cassidy ..... 292/40
1,556,864 A * 10/1925 Mendenhall ..... 292/33
1,897,080 A * 2/1933 Soper ..... 292/165
2,195,542 A * 4/1940 Shaffer et al. ..... 292/66
3,498,657 A * 3/1970 Fontana ..... 292/34
4,476,700 A * 10/1984 King ..... 70/99
4,878,699 A * 11/1989 Wronski ..... 292/143
5,090,750 A * 2/1992 Lindqvist ..... 292/7
5,219,191 A * 6/1993 Wolter ..... 292/157
5,244,238 A * 9/1993 Lindqvist ..... 292/7
5,603,534 A * 2/1997 Fuller ..... 292/2
5,791,700 A * 8/1998 Biro ..... 292/7
5,943,886 A * 8/1999 Chiang ..... 70/70
6,120,069 A * 9/2000 Taranto ..... 292/35
6,152,512 A * 11/2000 Brown et al. ..... 296/37.12
6,607,221 B1 * 8/2003 Elliott ..... 292/33
6,669,243 B2 * 12/2003 Katoh et al. ..... 292/34
7,036,852 B2 * 5/2006 Cho ..... 292/33
2003/0006616 A1 * 1/2003 Katoh et al. ..... 292/32

FOREIGN PATENT DOCUMENTS

JP 4-60079 2/1992

* cited by examiner

*Primary Examiner*—Brian E. Glessner
*Assistant Examiner*—Carlos Lugo
(74) *Attorney, Agent, or Firm*—McGinn IP Law Group, PLLC

(57) ABSTRACT

In this side lock apparatus, a opening and closing member is fixed to a support unit so that the opening and closing member can be opened and closed, left and right latches being movably held on the opening and closing member, the left and right latches being urged by a pressure of a spring toward a lock hole formed in the support unit, a free end portion of the latches being moved back from the lock hole in the support member against the spring means by an operation of the operating handle, wherein the left and right latches are operatively connected together via a link lever supported rotatably via a shaft on the opening and closing member, the operating handle being provided with an operating portion engageable with the latch, at least one latch being provided with two contact surfaces engageable with the operating portion of the operating handle.

7 Claims, 9 Drawing Sheets

SIDE LOCK APPARATUS FOR STORAGES

BACKGROUND OF THE INVENTION

1. Field of the Invention

The present invention relates to an improvement in a side lock apparatus for opening and closing members, such as, for example, a glove box fixed to an instrument panel of an automobile so that the glove box can be opened and closed.

2. Description of the Related Art

A related art side lock apparatus of this kind is formed (refer to, for example, JP-A-4-60079) by supporting left and right link levers rotatably via shafts in a housing fixed in a central portion of a glove box body (not concretely shown), providing at upper end portions of the left and right link levers a pair of latches which enter and get out of lock holes made in an instrument panel, and fixing between lower end portions of the left and link levers a tension coiled spring which urges the two latches in the direction in which the latches constantly engage the interior of the lock holes.

When the glove box body is in a closed state, the free end portions of the latches which are provided on the upper end portions of the left and right link levers are engaged with the opposed left and right lock holes of the instrument panel, and the glove box is thereby locked in its closing position. In order to open this glove box by releasing the glove box from the locked state thereof, projecting arms provided so as to face the intermediate portions of the left and right link levers are pressed down by a turning operation of the operating handle against the urging pressure of the tension coiled spring. As a result, the left and right link levers are turned in the direction opposite to the urging direction, so that the free end portions of the latches are moved back from the lock holes. This enables the glove box to be moved in its opening direction.

The operating handle in the related art side lock apparatus is supported via a shaft on a bearing member set up on the side of the housing so that the operating handle can be turned. Under the circumstances, in vehicles of right steering wheel specifications and left steering wheel specifications used in countries of different traffic laws, the positions in which the glove box is provided differ from each other. Therefore, in order to provide the operating handle of the side lock apparatus in a position other than a central portion of the glove box, it was necessary that the side lock apparatus including the operating handle be changed in the vehicles of the respective specifications. Even when the operating direction and operating system of the operating handle are necessarily changed due to the conditions and character of countries or fashion, a change of design of the side lock apparatus is made every time under compulsion.

SUMMARY OF THE INVENTION

The present invention has been developed so as to effectively solve the problems of such a related art side lock apparatus, and a first aspect of the invention employs a structure in which a opening and closing member is fixed to a support member so that the opening and closing member can be opened and closed, left and right latches being movably held on the opening and closing member, each of the left and right latches being urged by a pressure of a spring means toward a lock hole formed in the support member, a free end portion of each of the latches being moved back from the lock hole in the support member against the spring means by an operation of the operating handle, wherein the left and right latches are operatively connected together via a link lever supported rotatably via a shaft on the opening and closing member, the operating handle being provided with an operating portion engageable with the latches, at least one latch being provided with not smaller than two contact surfaces engageable with the operating portion of the operating handle.

Besides, the opening and closing member may be a box-shaped storage which can store articles, or a lid which opens and shuts the opening of a fixed box-shaped storage.

A second aspect of the invention is based on the first aspect of the invention, and employs a structure in which the opening and closing member is provided with a member for retaining one latch movably, the retainer member being detachable with respect to the opening and closing member and supporting the operating handle so that the operating handle can be turned or pressed.

A third aspect of the invention is based on the first aspect and the second aspect of the invention, and employs a structure in which the latch is provided with a projection-carrying elastic member, the link lever being provided with recesses engageable with the projection, the thickness of the link lever being smaller than that of the latch.

A fourth aspect of the invention is based on the first aspect to third aspect of the invention, and employs a structure in which the left and right latches have shaft portions at their respective rear ends, and holes through which the shaft portions of opposite latches are inserted, each of the holes having a brake means, one shaft portion being provided with a spring means.

A fifth aspect of the invention is based on the second aspect to fourth aspect of the invention, and employs a structure in which the latch has an elastic claw for tentatively fixing the retainer member.

In the first aspect of the invention, at least one latch has not smaller than two contact surfaces engageable with the operating portion of the operating handle. Therefore, when the position of the operating handle is changed freely along the latch with the operating portion of the operating handle kept engaged with the corresponding contact surface, it becomes possible to move back the free end portions of the left and right latches from the lock holes in the support member against a force of the spring means. This enables various operating directions and various operating systems of the operating handle to be provided.

In the second aspect of the invention, the retainer member supporting the operating handle so that the operating handle can be turned or pressed is made detachable with respect to the opening and closing member. Therefore, when the retainer member is fixed to an arbitrary portion of the opening and closing member, the position in which the operating handle is provided can be changed freely in a corresponding manner. In the third aspect of the invention, the thickness of the link lever is set smaller than that of the latch. Therefore, the thickness of the latch as a whole becomes small, and the thickness of the side lock apparatus itself can also be reduced. Therefore, a space capable of being taken to utilize for the opening and closing member of goods in this side lock apparatus can be enlarged as compared with that in the related art apparatus of this kind.

In the fourth aspect of the invention, the shaft portions are inserted through the opposed holes. Therefore, the resultant parts themselves complete a frame structure, which can withstands the deformation ascribed to torsional moment and the like. Since the holes have brake means, the unpleasant striking sound occurring when each latch fits into and comes out from the lock hole can be prevented. In the fifth aspect of the invention, an elastic claw for tentatively fixing the latch to the retainer member is provided. Therefore, the side lock apparatus can be delivered with the latches and retainer members in a tentatively combined state, and this causes the operation efficiency to be improved.

DETAILED DESCRIPTION OF THE PREFERRED EMBODIMENTS

The present invention will now be described on the basis of an illustrated preferred mode of embodiment thereof. The side lock apparatus in this mode of embodiment is also applied to a glove box fixed to an instrument panel of an automobile so that the glove box can be opened and closed. A body of the glove box is formed on the premise that the body is supported on a shaft rotatably with respect to a hollow of the instrument panel.

Figure 1:
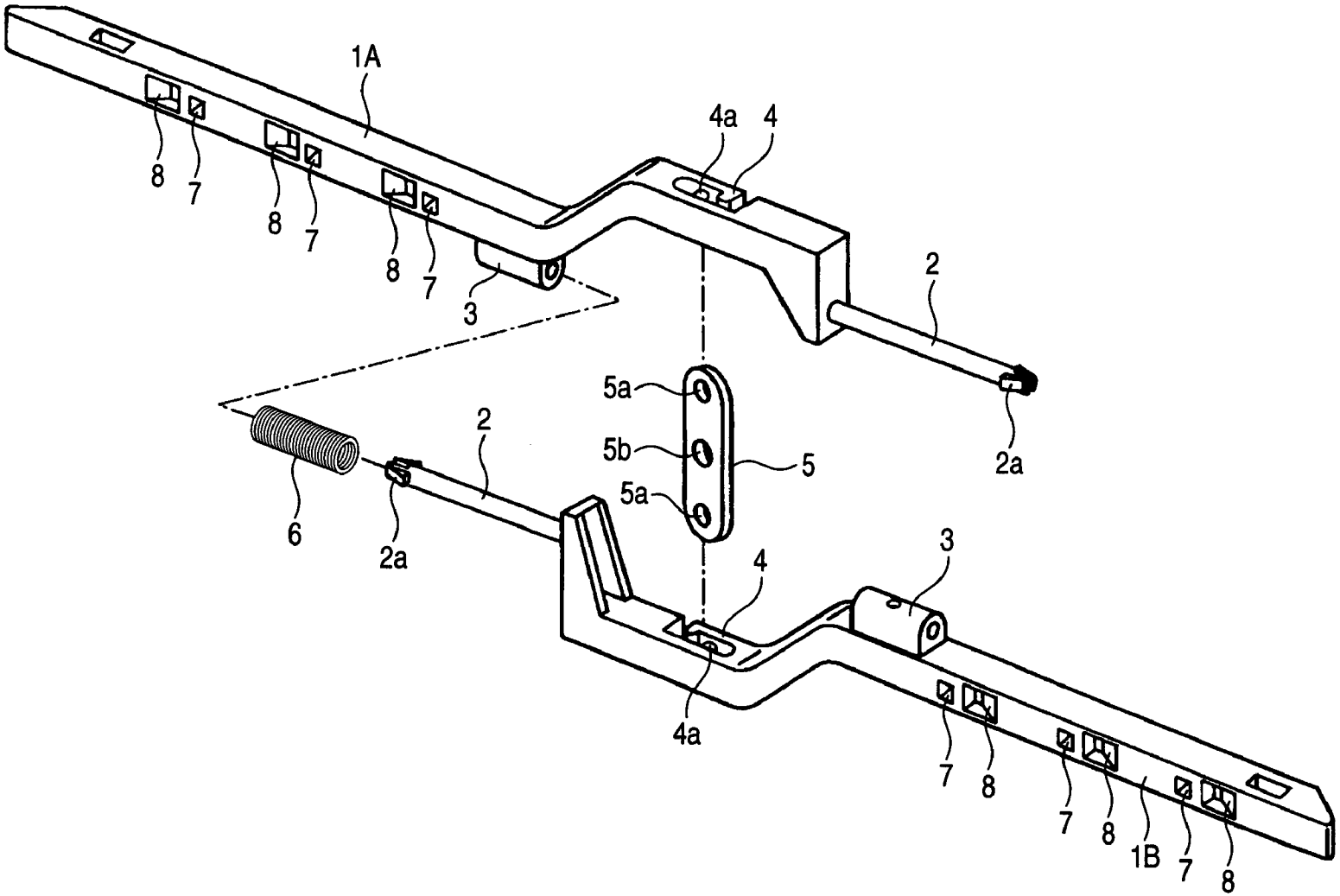
FIG. 1 is an exploded perspective showing from the side of an outer panel left and right latches provided in a mode of embodiment of the side lock apparatus according to the present invention.
Figure 2:
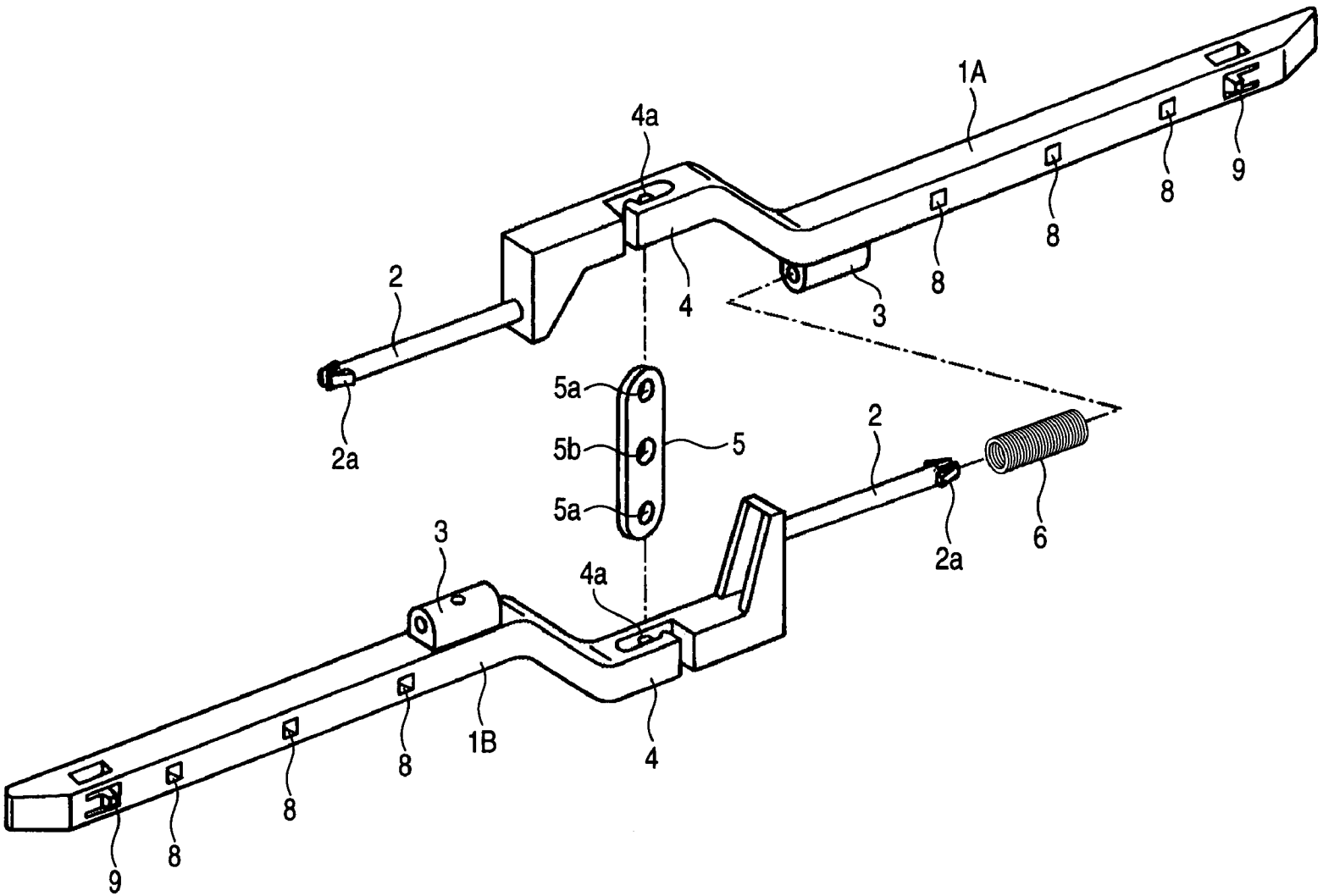
FIG. 2 is an exploded perspective showing left and right latches from the side of an inner panel.

In this mode of embodiment, the left and right latches held movably between an outer panel and an inner panel in a designed wall of the glove box body are formed as shown in FIG. 1 and FIG. 2. The two latches are formed so that the latches are vertically superposed on each other and can be connected together operatively in the vertical direction by bending one latch 1A upward at a rear end portion thereof and bending the other latch 1B downward at a rear end portion thereof; providing shaft portions 2, which are inserted through the interior of holes 3 which will be described later, and which have slip-off preventing claws, on rear end surfaces of the latches 1A, 1B so that the shaft portions are integral therewith; providing bent root portions of the latches with the holes 3, through which the shaft portions 2 are inserted; inserting the opposite shaft portions 2 through the holes 3 in the opposite directions, by which a frame structure is formed in these portions, the structure being able to withstand deformation ascribed to torsional moment and the like.

Owing to the power transmitted from operating handles 10A, 10B, 10C, 10D, which will be described later, to the first-mentioned clutch 1A, a link lever 5, which will be described later, is turned, so that the power is transmitted to the second-mentioned latch 1B to cause the glove box body to be opened. The latches 1A, 1B and link lever 5 are connected together owing to the loose engagement of projections 4*a* and end bores 5*a*, which will be described later, and the engagement of the link lever 5 and support posts (not shown) serving as fulcrums of rotation is also made with clearances left therebetween. Therefore, there is the possibility, when the opening power transmitted from the operating handles 10A, 10B, 10C, 10D to the latch 1B is transmitted to the link lever 5, that a torsional force and torsional moment work on the latch 1B due to the reaction force and reaction of the link lever 5 twisted during the transmission of the opening power. However, in this mode of embodiment, the bent portion of the latch 1A and that of the latch 1B are formed to a frame structure by connecting these bent portions together by their respective shaft portions 2 so that the frame structure surrounds the link lever 5. Therefore, the geometrical moment of inertia can be improved. This enables the frame structure to sufficiently resist the torsional force and torsional moment even when there are not sliding support members for the latches 1A, 1B in the vicinity of the link lever 5.

The latches 1A, 1B are engaged with lock holes of the instrument panel, and the end surfaces of the slip-off preventing claws 2*a* on the respective shaft portions 2 impinge upon end surfaces of the opposed holes. Therefore, a quantity of engagement of each latch with respect to the lock hole is limited, and the movements of the latches 1A, 1B are stopped to cause the glove box body to be closed with respect to the instrument panel. Under the circumstances, grease of a high viscosity is injected into the holes 3 in this mode of embodiment to cause a braking force to be displayed between the shaft portions and holes 3. Also, such grease of a high viscosity is applied between the slip-off preventing claws 2*a* and holes 3, and an impact occurring at the time of the collision of the end surfaces of the slip-off preventing claws 2*a* with those of the holes 3 thereby is lessened. The occurrence of a striking sound is thereby restrained. The present invention is not limited to this embodiment. The occurrence of a striking sound can also be held down by lessening an impact occurring at the time of the collision of the mentioned end surfaces by O-rings provided between the slip-off preventing claws 2*a* and holes 3, or by using a simple air damper formed by fitting O-rings around the shaft portions 2 and making in the holes 3 air discharge holes of a fine cross-sectional area which communicates inner portions of the holes 3 and the outside air with each other.

Figure 3:
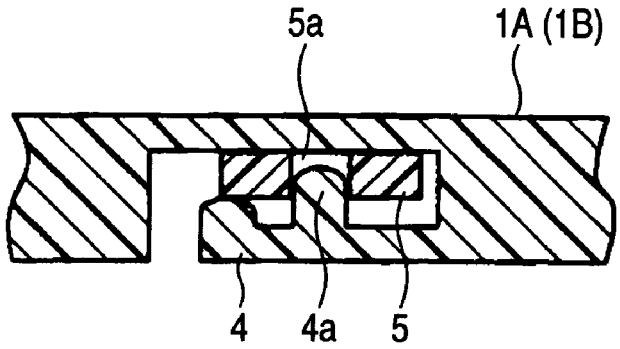
FIG. 3 is a sectional view of a principal portion of the apparatus, showing the condition of an end hole of a link lever engaged with a projection of an elastic member.

In addition to these techniques, the left and right latches 1A, 1B are recessed at intermediate sections of their respective bent portions, and elastic members 4 having projections 4 are provided in the recessed regions so that the elastic members 4 are integral with the recessed regions. The projections 4*a* of the elastic members 4 are fitted in the end bores 5*a* constituting recesses formed at both end portions of the link lever 5, and the left and right latches 1A, 1B are thus connected together so that the latches 1A, 1B can be moved together. A compression coiled spring 6 constituting a spring means for urging free end portions of the left and right latches 1A, 1B toward the lock hole formed in the instrument panel is fitted around the shaft portion 2 of the second-mentioned latch 1B. The link lever 5 mentioned above is supported rotatably via a shaft on a support post (not shown) provided on an outer panel via a central bore 5*b* of the link lever. As shown in FIG. 3, the thickness of the link lever 5 is set so that the thickness becomes smaller than that of the latches 1A, 1B, and the latches 1A, 1B as a whole are thereby made thin. Since the side lock apparatus can be made thin owing to such thin link lever and latches conjointly with the effect of the latches 1A, 1B in a vertically superposed condition. This enables a space capable of being utilized effectively of the glove box can be taken widely as compared with that in the related art side lock apparatus.

Flat side surfaces, which face the outer panel, of the left and right latches 1A, 1B are provided as shown, especially, in FIG. 1 with a plurality of sets of a blind type first engagement bore 7 and a through type second engagement hole 8 in a combined relation at predetermined intervals. The portions of the flat side surfaces facing an inner panel which are close to free ends of the latches are provided as shown in FIG. 2 with elastic claws 9 adapted to tentatively fix retainer members 11A, 11B, 11C, 11D which maintain the first-mentioned latch 1A (which will be described later) movably. The side lock apparatus is formed so that, when the latches 1A, 1B and retainer members are delivered in a tentatively combined state, the efficiency of assembling work can be improved. In each first engagement hole 7, a contact surface 7*a* extending at right angles to a line along which the latches 1A, 1B are moved is formed. In each second engagement hole 8, a contact surface 8*a* inclined with respect to the line along which the latches 1A, 1B are moved is formed. Referring to FIG. 2, the holes seen in side surfaces of the latches 1A, 1B are the through hole type second engagement holes 8 mentioned above.

Figure 4:
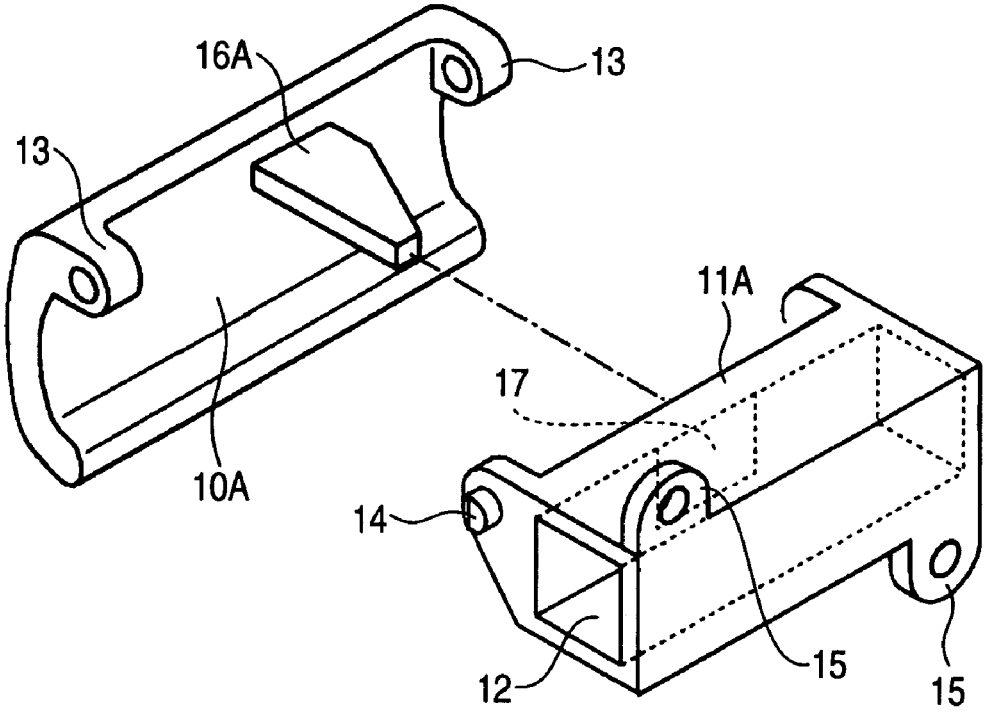
FIG. 4 is an exploded perspective showing a vertically turning type operating handle and its retainer member.

Therefore, in order to use the operating handle 10A adapted to be turned vertically from the lower side to the upper side for the left and right latches 1A, 1B of such construction, a retaining hole 12 for holding the free end portion of the latch 1A movably, a shaft portion 14 fitted in bearing holes 13 of the operating handle 10A, fixing members 15 secured to the outer panel, and an insert hole 17 from which a tapering operating portion 16A of the operating handle 10A is inserted into the interior of the retaining hole 12 are first formed in the retainer member 11A for the operating handle 10A as shown in FIG. 4. The operating handle 10A is provided with bearing holes 13 at both sides thereof engaged with the shaft portion 14, and the tapering operating portion 16A inserted into the interior of the already-mentioned second engagement hole 8. The retainer member 11A shall support the operating handle 10A so that the operating handle 10A can be turned, by engaging the bearing holes 13 and the shaft portion 14 with each other.

When the retainer member 11A is opposed to an arbitrary second engagement hole 8 and screwed to the outer panel via the fixing members 15 as the free end portion of the latch 1A is inserted into the retaining hole 12 of the retainer member 11A, the tapering operating portion 16A of the operating handle 10A supported on the retainer member 11A is inserted into the second engagement hole 8. In this case, the free end portion only of the latch 1A is held via the retainer member 11A, while the free end portion of the latch 1B is held directly in the through hole made in a side wall of the glove box body. Therefore, there is not the possibility that the operations of the two latches 1A, 1B are hampered. Of course, it is needless to say that the free end portion of the latch 1A be also held in a through hole.

Figure 5:
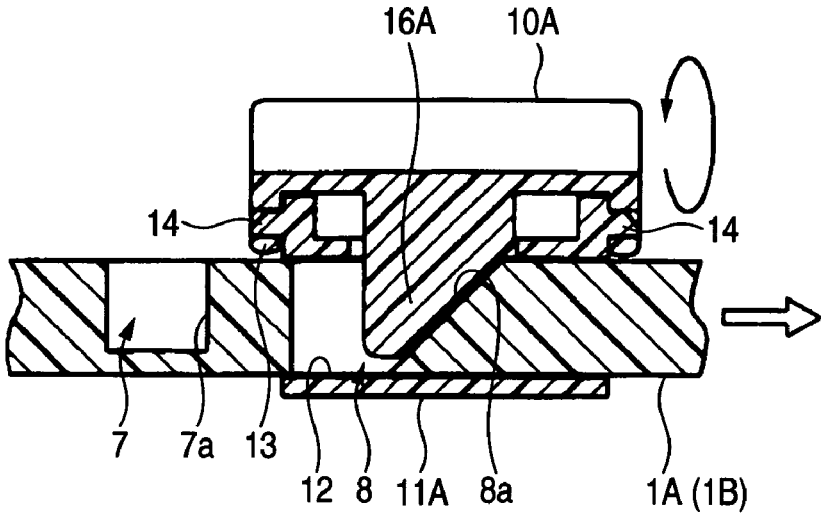
FIG. 5 is a sectional view of a principal portion of the apparatus, showing the condition of a latch moved back by the vertically turning type operating handle.

The operating handle 10A is thereafter turned. As a result, the tapering operating portion 16A of the operating handle 10A is slidingly moved along the inclined contact surface 8*a* of the opposed second engagement hole 8 as shown in FIG. 5. This sliding movement of the operating portion causes the free end portion of the latch 1A to be moved back from the lock hole of the instrument panel against the urging pressure of the compression coiled spring 6, and the free end portion of the latch 1B to be also moved back at the same time from the lock hole owing to the operation of the link lever 5. This enables the glove box to be moved in the opening direction. Even when an operating handle turned vertically from the upper side to the lower side is used, this embodiment shall be put to use on the same principle. When the operating handle 10A is released from the turning operation, the operating handle 10A returns to the original closed condition automatically by the urging force of the compression coiled spring 6.

Figure 6:
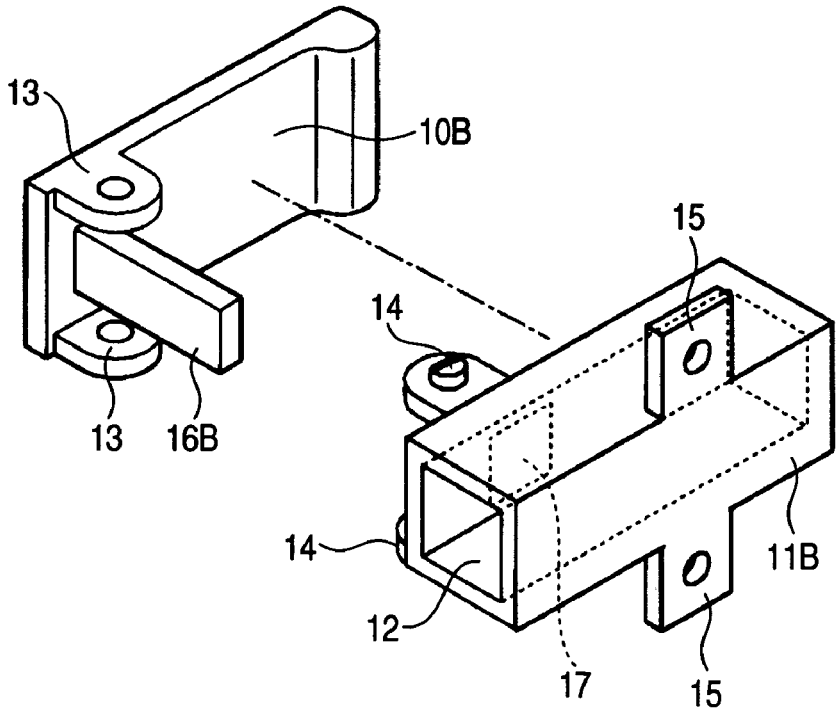
FIG. 6 is an exploded perspective showing a laterally turning type operating handle and its retainer member.

When an operating handle 10B turned laterally from the left side to the right side is used for the left and right latches 1A, 1B, a retainer member 11B for the same handle 10B is provided as shown in FIG. 6 with an insert hole 17 from which a linear operating portion 16B is inserted into the retaining hole 12, in addition to such retaining hole 12, shaft portions 14 and fixing members 15 as mentioned above. The operating handle 10B is provided with bearing holes 13 and linear operating portion 16B at one end side thereof, and operating member 11B shall support the operating handle 10B so that the operating handle 10B can be turned, by engaging the bearing holes 13 and shaft portions 14 with each other.

When the retainer member 11B is opposed to an arbitrary first engagement hole 7 and screwed to the outer panel via the fixing members 15 as the free end portion of the latch 1A is inserted through the retaining hole 12 of the retainer member 11B, the linear operating portion 16B of the operating handle 10B supported on the retainer member 11B is inserted into the first engagement member 7. In this case, the free end portion only of the latch 1A is also held via the retainer member 11B, while the free end portion of the latch 1B is held directly in the through hole formed in a side wall of the glove box.

Figure 7:
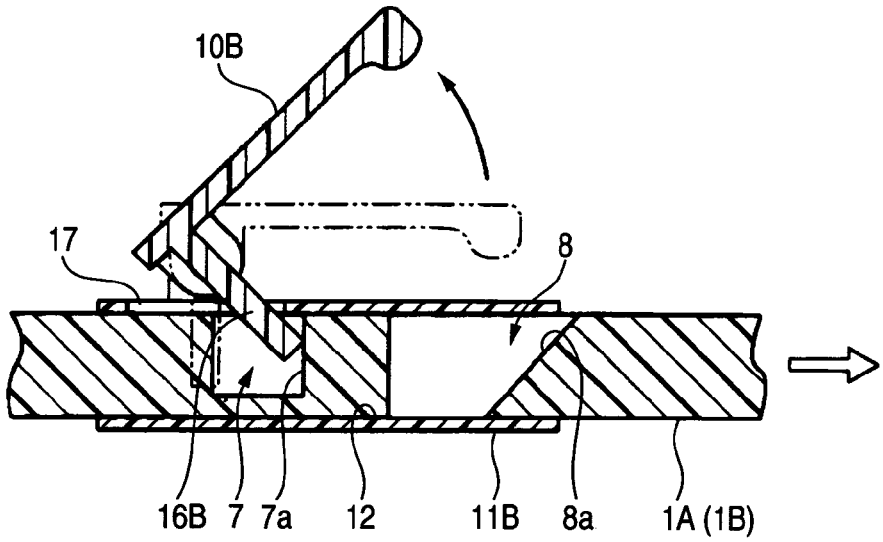
FIG. 7 is a sectional view of a principal portion of the apparatus showing the condition of a latch moved back by the laterally turning type operating handle.

The operating handle 10B is thereafter turned. As a result, the linear operating portion 16B of the operating handle 10B is slidingly moved along the right-angled contact surface 7*a* of the first engagement hole 7 as shown in FIG. 7. This sliding movement of the sliding portion causes the free end portion of the latch 1A to be moved back from the lock hole of the instrument panel against the urging pressure of the compression coiled spring 6, and the free end portion of the latch 1B to be also moved back at the same time from the lock hole owing to the operation of the link lever 5. This enables the glove box to be moved in the opening direction. Even when an operating handle turned laterally from the right side to the left side is used, this embodiment shall be put to use on the same principle. When the operating handle 10B is released from the turning operation, the operating handle 10B returns to the original closed condition automatically by the urging force of the compression coiled spring 6.

Figure 8:
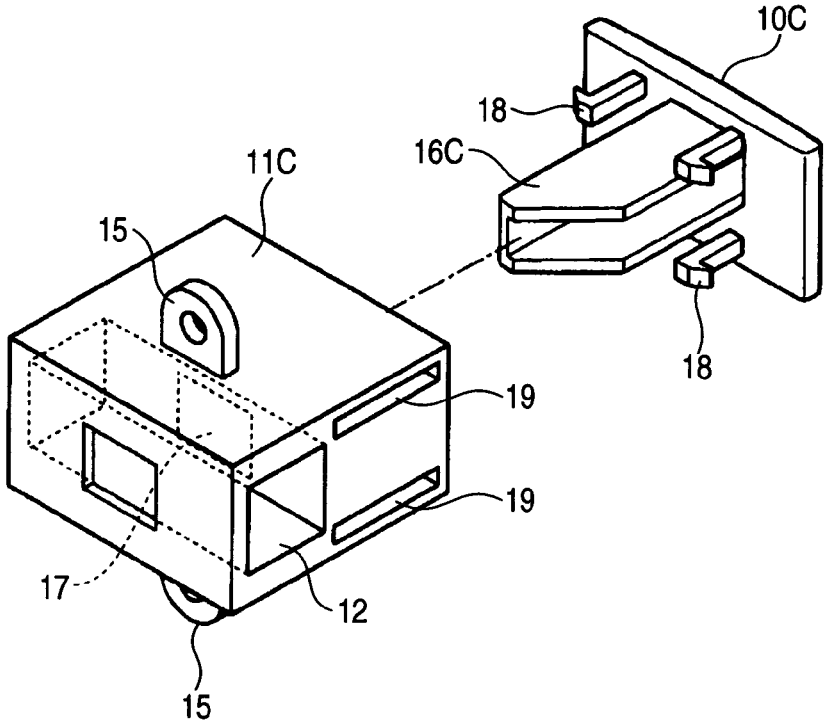
FIG. 8 is an exploded perspective showing a push type operating handle and its retainer member.

When a push type operating handle 10C is used for the left and right latches 1A, 1B as shown in FIG. 8, a retainer member 11C for the operating handle 10C is provided in addition to such retaining hole 12 and fixing members 15 as mentioned above with an insert hole 17 from which a tapering operating portion 16C of the operating handle 10C is inserted into the retaining hole 12, slits 19 for regulating a traveling distance and a position of engagement legs 18 provided on the operating handle 10C, and walls 19*a* for guiding the movements of the engagement legs 18, while the operating handle 10C is provided with a tapering operating portion 16C on a central portion thereof, and four engagement legs 18 around the operating portion 16C. The operating handle 10C shall be supported by the retainer member 11C so that the operating handle 10C can be pressed in the direction crossing the latches at right angles thereto, by inserting the engagement legs 18 into the slits 19.

The free end portions of the four engagement legs 18 are inserted into the slits 19 to obtain the condition in which inner surfaces of the engagement legs 18 are brought into sliding contact with the guide walls 19*a*. When the retainer member 11C is opposed to an arbitrary second engagement hole 8 and screwed to an outer panel via the fixing members 15 as the free end portion of the latch 1A is inserted into the retaining hole 12 of the retainer member 1C, the tapering operating portion 16C of the operating handle 10C supported by the retainer member 11C is inserted into the second engagement hole 8. In this embodiment, the free end portion only of the latch 1A is also held via the retainer member 1C, while the free end portion of the other latch 1B shall be held directly in a through hole formed in a side wall of a glove box.

Figure 9:
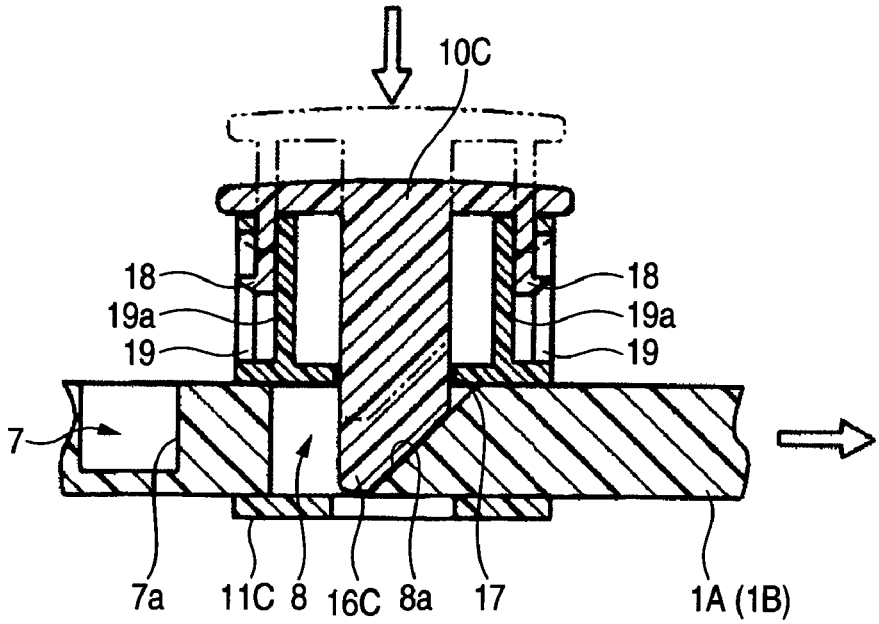
FIG. 9 is a sectional view of a principal portion of the apparatus, showing a latch moved back by the push type operating handle.

The operating handle 10C is pressed toward the retainer member 1C. As a result, the tapering operating portion 16C of the operating handle 1C is slidingly moved along an inclined contact surface 8*a* of a second engagement hole 8 as shown in FIG. 9. This sliding movement of the operating portion causes the free end portion of the latch 1A to be moved back from the lock hole of the instrument panel against the urging pressure of the compression coiled spring 6, and the free end portion of the latch 1B to be also moved back at the same time from the lock hole owing to the operation of the link lever 5. This enables the glove box to be moved in its opening direction. When the operating handle 10C is released from the pressing operation of the operating handle 10C, the operating handle 10C returns to the original closed condition automatically by the urging force of the compression coiled spring 6.

Figure 10:
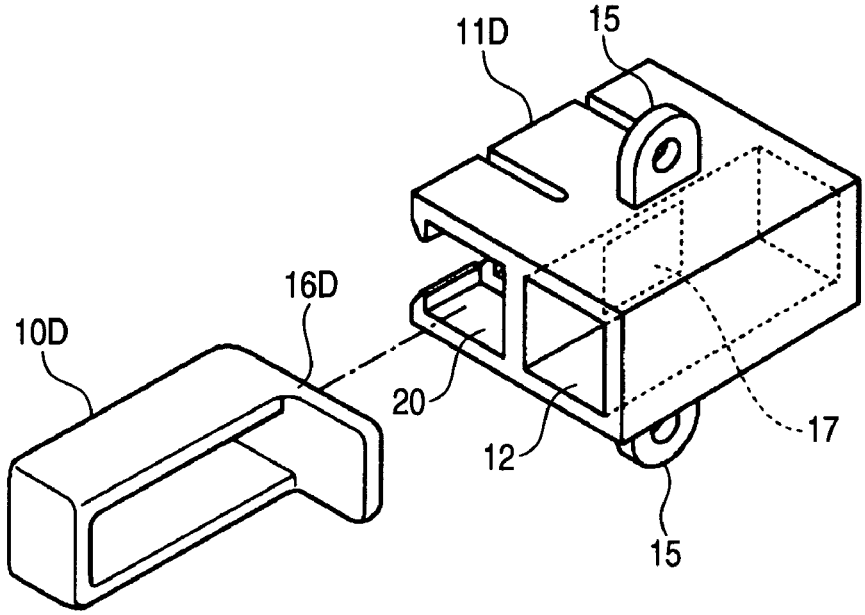
FIG. 10 is an exploded perspective showing a slide type operating handle and its retainer member.
Figure 11:
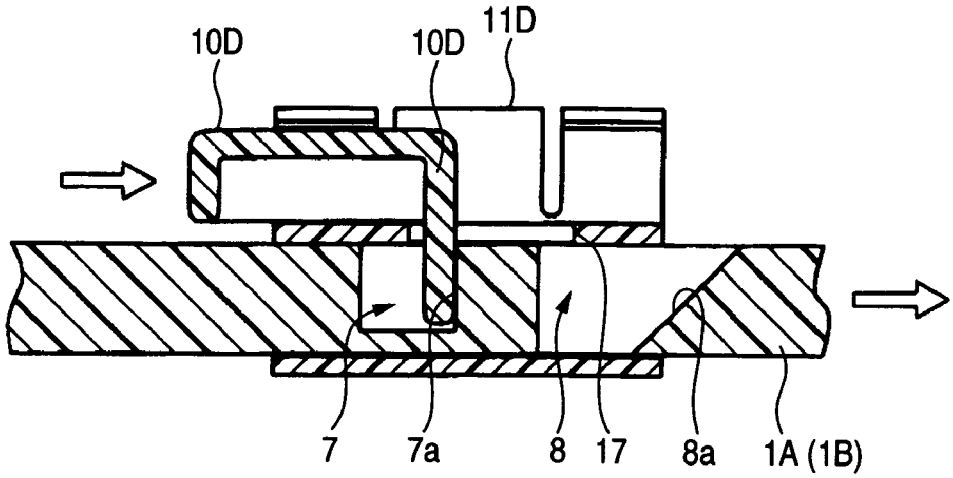
FIG. 11 is a sectional view of a principal portion of the apparatus, showing the condition of a latch moved back by the slide type operating handle.

When a slide type operating handle 10D is used for the left and right latches 1A, 1B as shown in FIG. 10, a retainer member 11D therefor is provided in addition to such a retaining hole 12 and fixing members 15 as mentioned above with an insert hole 17 from which a linear operating portion 16D of the operating handle 10D is inserted into the retaining hole 12, and a recess-carrying support hole 20 supporting the operating handle 10D slidably, while the operating handle 10D is provided with the linear operating portion 16D at one end section thereof. When the operating handle 10D is supported in the support hole 20 with the flexure of the support hole 20 obtained, the operating handle 10D shall be supported by the retainer member 11D so that the operating handle 10D can be laterally pressed.

When the retainer member 11D is opposed to an arbitrary first engagement hole 7 and screwed to the outer panel via the fixing members 15 as the free end portion of the latch 1A is inserted into the retaining hole 12 of the retainer member 11D, the linear operating portion 10D of the operating handle 10D supported by the retainer member 11D is fitted in the first engagement hole 7 thereof. In this embodiment, the free end portion only of the latch 1A is also held via the retainer member 11D, and the free end portion of the latch 1B is held directly by a through hole formed in a side wall of the glove box body.

The operating handle 10D is thereafter pressed along the retainer member 11D. As a result, the linear operating portion 16D of the operating handle 10D is slidingly moved along a contact surface 7*a*, which cross the relative latch at right angles, of the first engagement hole 7 to cause the free end portion of the latch 1A to be moved back from the lock hole of the instrument panel against the pressure of the compression coiled spring 6, and the free end portion of the latch 1B to be also moved back at the same time owing to an operation of the glove box. This enables the glove box to be moved in the opening direction thereof. When the operating handle 10D is released from the turning operation, the operating handle 10D returns to the original closed condition automatically by the urging force of the compression coiled spring 6.

In the above-described embodiments, the operating handle 10A, 10B, 10C, 10D is supported in an arbitrary setting position via the retainer member 11A, 11B, 11C, 11D on the side of the latch 1A, and the present invention is not limited to these embodiments. Since a structure identical with that of the latch 1A is also given to the latch 1B, the operating handle 10A, 10B, 10C, 10D can also be supported in an arbitrary setting position via the retainer member 11A, 11B, 11C, 11D on the side of the latch 1B. In any case, the operating handle 10A, 10B, 10C, 10D can be supported in an arbitrary setting position by merely selecting the fixing position for the retainer member 11A, 11B, 11C, 11D which support the operating handle 10A, 10B, 10C, 10D so that the operating handle can be turned or pressed.

Since the operating handle 10A, 10B, 10C, 10D and latches 1A, 1B in this mode of embodiment exist on the front side and rear side respectively of the outer panel, the operating portion 16A, 16B, 16C, 16D of the operating handle 10A, 10B, 10C, 10D is necessarily inserted into the interior of the engagement holes 7, 8 through openings (not shown) provided in the outer panel. When the setting position of the operating handle 10A, 10B, 10C, 10D is changed, the position of the above-mentioned opening of the outer panel has also to be changed at once but it is not necessary that the design of the side lock apparatus itself be changed.

The retainer members 11A, 11B, 11C, 11D which support the link lever 5 supported via a shaft, and operating handle 10A, 10B, 10C, 10D so that the operating handles can be turned or pressed, and which hold the latches 1A, 1B so that the latches can be slidingly moved are all fixed to the rear side of the outer panel. Therefore, when the position in which the operating handle 10A, 10B, 10C, 10D is set is changed, the positions in which a support post (not shown) is set, which supports the link lever 5, and a fixing seat for the fixing members 15 of the retainer member 11A, 11B, 11C, 11D may only be changed simultaneously with the change of the position of the opening mentioned above. A design changing operation and the production of a manufacturing metal mold can also be carried out by a required minimum labor and at a required minimum cost.

As has been described above, the retainer member 11A, 11B, 11C, 11D holds the latches 1A, 1B slidably on both sides of the contact surfaces 7*a*, 8*a*, so that an opening force can be transmitted from the operating handle 10A, 10B, 10C, 10D to the latches 1A, 1B smoothly even when the direction of the force is varied.

Therefore, when the common left and right latches 1A, 1B are used in this mode of embodiment, the position in which the operating handle 10A, 10B, 10C, 10D is set can be changed freely even in a vehicle of the right steering wheel specifications and left steering wheel specifications, and even when the apparatus as a whole is not changed. The direction in which the apparatus is operated can also be changed freely by using a vertically turning type operating system and a laterally turning type operating system. The operating system can be changed freely as well to a turning type system, a push type system and a slide type system. Therefore, it becomes unnecessary that the design of the side lock apparatus be changed each occasion.

Figure 12:
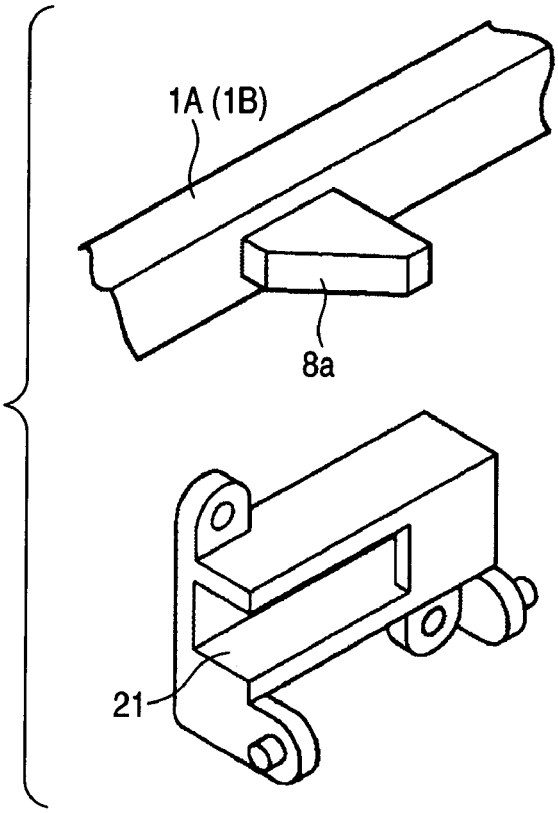
FIG. 12 is an exploded perspective showing another example of the contact surface with which the operating portion of the operating handle is engageable and another example of the retainer member.
Figure 13:
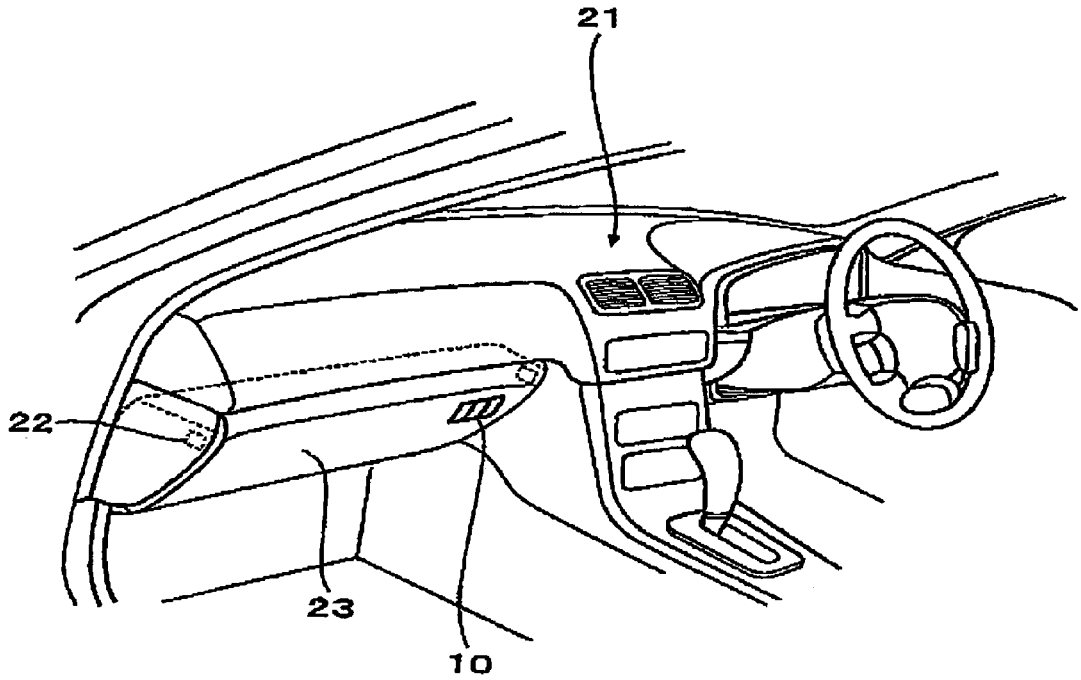
FIG. 13 is a perspective view of the instrumental panel depicting the support member 21, the lock holes 22 and the lid 23 (opening and closing member) of the glove box.
Figure 14:
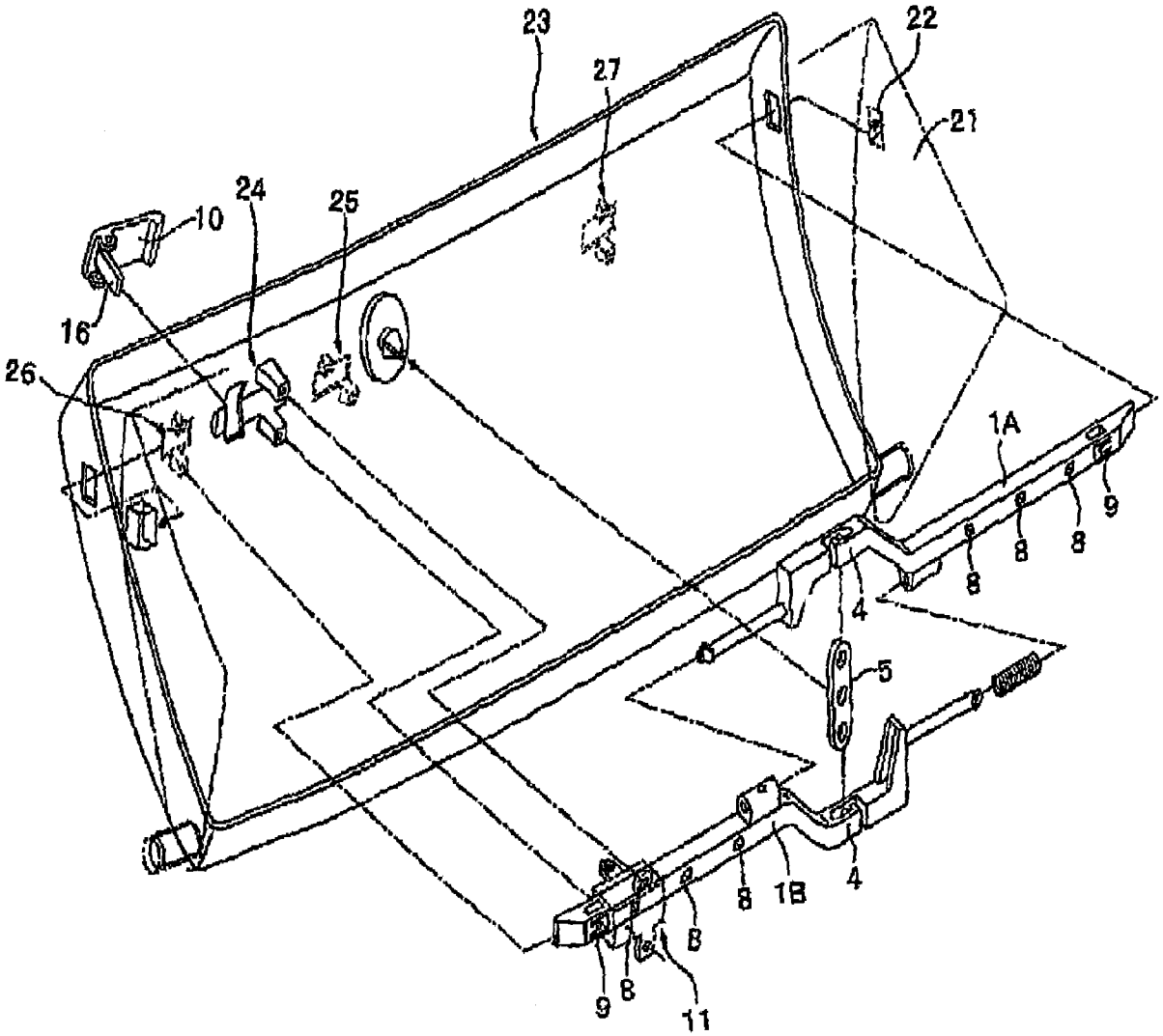
FIG. 14 is an exploded perspective view illustrating the lid 23 (opening and closing member), the support member 21, the lock holes 22 and the fixing structure 24, 25, 26, and 27 in relation to the left and right latches of the side lock apparatus.

In the above-described embodiments, the contact surfaces with which the operating portion 16A, 16B, 16C, 16D of the operating handle 10A, 10B, 10C, 10D is engaged are formed on the inner sides of the latches 1A, 1B but this invention is not limited to these embodiments. For example, as shown in FIG. 12, it is also possible to form a contact surface 8*a* projecting from a side surface of each of the latch 1A, 1B, and provide in the retainer member 11A, 11B, 11C, 11D with a recess allowing a movement of the projecting contact surface 8*a*. However, when the structures of the embodiments are employed, the reducing of the thickness of the latches 1A can be done advantageously.

In either case, it is needless to say that, when the glove box body is in a closed condition (not concretely shown), the free end portions of the left and right clutches 1A, 1B fit in the corresponding left and right lock holes of the instrument panel, and lock the glove box in its closed position.

According to the present invention described above, at least one latch has not smaller than two contact surfaces engageable with an operating portion of an operating handle owing to the employment of the above-described structure. Therefore, when the operating handle is actuated as the operating portion thereof is engaged with a corresponding contact surface by changing the position of the operating handle freely along the latch, the free end portions of the left and right latches can be moved back from a lock hole of a support member against an urging spring means. This enables various directions in which the operating handle is moved and various systems for moving the operating handles to be provided.

What is claimed is:

1. A side lock apparatus for an opening and closing member comprising:

a support member fixed to a the opening and closing member so that the opening and closing member can be opened and closed;

left and right latches movably held on the opening and closing member;

a spring unit; and a link lever, wherein the left and right latches are urged by a pressure of the spring unit toward a lock hole formed in the support member, a free end portion of the latches being moved back from the lock hole of the support member against the spring unit by an operation of an operating handle;

wherein the left and right latches are operatively connected together via the link lever supported rotatably via a shaft on the opening and closing member, wherein the operating handle is provided with an operating portion engageable with a relative latch of said left and right latches, wherein at least one of said left and right latches is provided with two contact surfaces, and an operating portion of the operating handle is engageable with one of the two contact surfaces.

2. A side lock apparatus for an opening and closing member according to claim 1, wherein the opening and closing member is provided with a retainer member for retaining one latch movably, the retainer member being detachable with respect to the opening and closing member and supporting the handle so that the operating handle can be turned or pressed.

3. A side lock apparatus for an opening and closing member according to claim 1, wherein said left and right latches are provided with a projection-carrying elastic member, the link lever being provided with recesses engageable with the projection, the thickness of the link lever being smaller than that of the latch.

4. A side lock apparatus for an opening and closing member according to claim 1, wherein the left and right latches comprise shaft portions at their respective rear ends, and holes through which the shaft portions of opposite latches are inserted, each of the holes having a brake means, one shaft portion being provided with the spring unit.

5. A side lock apparatus for an opening and closing member according to claim 2, wherein said left and right latches comprise an elastic claw for tentatively fixing the retainer member.

6. A side lock apparatus for an opening and closing member comprising:

left and right latches movably held on the opening and closing member;

a spring means; and a link lever, wherein the left and right latches are urged by a pressure of the spring means toward a lock hole formed in a support member that is fixed to the opening and closing member, a free end portion of the latches being moved back from the lock hole of the support member against the spring means by an operation of an operating handle, wherein the left and right latches are operatively connected together via the link lever supported rotatably via a shaft on the opening and closing member, wherein the operating handle is provided with an operating portion engageable with a relative latch of said left and right latches;

wherein at least one of said left and right latches is provided with two contact surfaces, and an operation portion of the operating handle is engageable with one of the two contact surfaces.

7. A side lock apparatus for an opening and closing member comprising:

a left latch and a right latch movably held on the opening and closing member, the left latch and the right latch comprising two contact surfaces, wherein the left latch and the right latch are urged by a spring, a free end portion of the left latch and the right latch being moved against the spring by an operation of respective operating handles, and wherein the operating handles are provided with an operating portion engageable with a respective latch of the left latch and the right latch, the operating portion of the operating handle engaging a respective contact surface of the left latch and the right latch depending on an operating handle that is used.

* * * * *